US006177206B1

(12) United States Patent
Sullivan et al.

(10) Patent No.: US 6,177,206 B1
(45) Date of Patent: Jan. 23, 2001

(54) SURFACE QUALITY ENHANCEMENT OF AEROSPACE SKIN SHEET

(75) Inventors: David Dean Sullivan, Buhler; Larry Kerschner, Hutchinson, both of KS (US)

(73) Assignee: Alcoa Inc., Pittsburgh, PA (US)

( * ) Notice: Under 35 U.S.C. 154(b), the term of this patent shall be extended for 0 days.

(21) Appl. No.: 09/186,557

(22) Filed: Nov. 5, 1998

(51) Int. Cl.[7] ..... B32B 3/00; B24B 1/00

(52) U.S. Cl. ..... 428/687; 29/90.01; 29/DIG. 2; 29/DIG. 19; 244/130; 244/133; 428/650; 428/927; 451/28; 451/57; 451/58; 451/66; 451/109; 451/111; 451/178; 451/259; 451/901

(58) Field of Search ..... 428/687, 927, 428/650; 451/28, 57, 58, 66, 109, 111, 178, 259, 901; 29/90.01, DIG. 2, DIG. 7, DIG. 19; 148/437; 244/130, 133

(56) References Cited

U.S. PATENT DOCUMENTS

| | | | | |
|---|---|---|---|---|
| 2,269,197 | * | 1/1942 | Hamilton | 451/901 |
| 3,093,459 | * | 6/1963 | Siebel et al. | 428/687 |
| 3,098,724 | * | 7/1963 | Anderson | 428/687 |

* cited by examiner

*Primary Examiner*—Deborah Jones
*Assistant Examiner*—Robert R. Koehler
(74) *Attorney, Agent, or Firm*—Charles Q. Buckwalter

(57) ABSTRACT

The present invention is directed to polishing the surface of an airplane part to an improved specularity by adding the additional step of sanding prior to the polishing step.

62 Claims, 1 Drawing Sheet

SURFACE QUALITY ENHANCEMENT OF AEROSPACE SKIN SHEET

FIELD OF THE INVENTION

This invention is directed to preparing and finishing the surface quality of aerospace skin sheet to enhance the specularity and reflectance of skin sheet.

BACKGROUND OF THE INVENTION

The surface of aerospace skin sheet is important for a variety of aerospace reasons. As is evident from a visual inspection of the different member airlines of the airline industry, some airlines prefer to paint the exterior of their airplanes, others prefer an unpainted surface, and some prefer both.

With an unpainted surface the aluminum may oxidize somewhat but there are certain disadvantages to painting an aircraft. One such disadvantage of painting the exterior of the airplane is that it adds weight. Paint may add as much as 200 to 700 pounds to the overall weight, dependent upon the size of the aircraft. Adding weight to an airplane affects load capacity, fuel capacity, additional maintenance, which funnels into diseconomies for the airline industry.

There are additional problems in painting the surface. While in the first instance the paint decorates and protects the surface, paint can also entrap moisture between the paint and aluminum layer promoting corrosion of the underlying aluminum surface and peeling of the paint. The friction of the air as it passes over the aircraft will deteriorate a painted surface, add additional drag, and decrease the economic benefits.

Pristine surfaces of aluminum have less drag when the aircraft is in use since the smoothness of the surface provides less frictional resistance. An unpainted aluminum surface also provides a lighter aircraft, which provides a weight and fuel advantage thus resulting in a more economical in-service aircraft.

Polishing the surface of aerospace skin sheet has been a labor intensive, time consuming, and costly process. One of the major defects, among others, in aluminum and aluminum alloy surfaces is a phenomenon called "orange peel", which visually can look like a starry sky when light is reflected. While it is not exactly known how orange peel is created on the surface of the aluminum, although many theories exist, it is known that it is undesirable by both those airlines that do not paint their aircraft and those that do. Consequently, to arrive at an acceptable surface quality the surface of the aluminum must be treated to rid itself of this scourge. Unless treated in a rigorous manner, the orange peel remains making the piece of skin sheet economically unacceptable. Unacceptable aluminum skin sheet in the aerospace aluminum and aluminum alloy art of today is also known as scrap.

Another problem in aluminum surfaces are defects called blemishes. Blemishes can occur from a variety of incidences, such as defects incurred during the rolling process or during shipping, storing, handling, and ordinary day to day treatment of inventoried skin sheet. These blemishes are also unacceptable under aerospace customer specifications and either must be fixed or the sheet may be scrapped.

Recovery rate for blemished skin sheet may be defined as the capability to take blemished skin sheet and turn it into a commercial sheet that the aerospace industry would readily accept. The recovery rate of blemished sheets from either orange peel and/or blemishes is historically very low.

In its ordinary workings, to arrive at an acceptable polished aluminum and/or aluminum alloy surface it can take as much as 2 to 3 hours of rigorous treatment of the surface of the skin sheet. At the outset, polishing the surface of the skin sheet under the prior art requires the single step of placing the sheet in an apparatus called a polishing machine. These machines are generally very large, expensive, and capital intense. The machines are usually equipped with a polishing means, such as a soft brush roll. Once the sheet has been lifted into place on a part of the machine where it can be held in a flat position the sheet is movably brushed against the roll to thereby polish or buff. One sweep back and forth on the length of the entire sheet counts as one pass. It may take as many as 40 passes for a sheet to become acceptable and thereby meet the required aerospace specification. Typically, if at 40 passes a surface inspector determines that the sheet will not meet the specification, the piece will be scrapped. If not scrapped the sheet is then passed on to inventory to await customer delivery.

Repairing blemished sheets, on the other hand, is a process that has evolved over the years into a complex array of steps and processes that are lengthy and costly. Often a repair person must spend hours on hands and knees sanding and/or burnishing, and then polishing an isolated blemish. For example, defects known as comet tails are visually apparent upon surface visual inspection, and while isolated on the surface can number in the hundreds on a single sheet from time to time. As the name evokes, comet tails start as a surface inclusion the can produce a considerable gouge with an appended comet tail. Comet tails can occur during polishing or prior thereto but become apparent during polishing. Other defects also become apparent during polishing and in order to correct the defect, the sheet must be taken off the polishing machine and hand sanded, hand polished, then subsequently placed on the polishing machine again to blend the hand polish with the machine polish to produce a homogeneous surface polish.

Repair activities incur an additional disadvantage due to inherent ergonomic challenges. The repetitive hand movements and hand rotations required to polish the sheet require a worker to use certain motions that caused a variety of ailments. Such ailments lead to worker injury and absence, let alone the misery of the ailment itself.

The invention hereof, has solved many of these problems in the prior art. The invention requires a significantly decreased number of polishing passes and consequently has decreased the time entailed in the polishing activity. The inventive process also has decreased the onerous process involved in the repair activity, decreasing the time to effect that repair and decreasing the time to polish the repair with a resultant decrease in ergonomic injuries.

SUMMARY OF THE INVENTION

The present invention is directed to a process for treating an aluminum or aluminum alloy surface for use as an airplane part such as a wing structure, fuselage, empennage, and or other parts of the exterior of an airplane to create a smooth and shiny surface wherein substantially the entire exterior surface or pails thereof are sanded and subsequently the entire sanded surface of the exterior surface or parts thereof are buffed. This is a process which comprises sanding with a single or a communicating plurality of mechanical sanders to remove defects on the surface of an as-received and/or inventoried aerospace skin sheet, optionally including a single or plurality of intermediate finishing steps, and subsequently polishing the sanded surface with a plurality of passes on the polishing machine.

Sanding the surface of the aluminum skin sheet removes substantially the entire class of defects or a majority of the portions of defects and blemishes such as orange peel which is a significant and deleterious component of a weathered and/or manufactured piece of aluminum and/or aluminum alloy. In a preferred embodiment sanding removes a majority of defects from the surface of the skin sheet. In a more preferred embodiment sanding removes a substantial portion of the defects, more than a majority, but less than substantially all. In it's most preferred embodiment sanding the surface removes substantially all of the defects. Defects in this context means but is not limited to things attached or in some manner that are a part of the surface of the skin sheet but occur as an undesirable condition such as dirt, metal filings, slivers, etc. but in particular orange peel.

Sanding the surface of the aluminum skin also removes unwanted blemishes. In a preferred embodiment sanding removes a majority of the blemishes. In a more preferred embodiment sanding removes a substantial portion of the blemishes, more than a majority but less than substantially all. In the most preferred embodiment, sanding removes substantially all of the blemishes.

Although the inventor hereof does not wish to be held to any single theory, it is believed that sanding roughens the surface of skin sheet and in so doing averages the peaks and valleys on the skin sheet surface in preparation for a single or plurality of finishing and/or polishing activities. The mechanical means used to sand comprises a host of mechanical sanders and/or combinations thereof in communication with an abrasive means such as sandpaper. Some are more preferred than others, however, the teaching hereof is the use of any and all mechanical devices used for sanding prior to an optional finishing and then the final polishing step. It is preferred to use a single or a plurality of communicating rotary and/or orbital type sanding heads. It is more preferred to use a plurality of communicating rotary and/or orbital sanding heads and some combination thereof. It is contemplated hereof that the mechanical sanding will be fully automated to provide a uniform concerted sanding step that will remove orange peel and/or blemishes in a single or plurality of passes wherein the automated machine may be comprised of belt, roll, and/or orbital means and/or some combination thereof A finishing activity can be an activity incorporating an intermediate step between sanding and polishing that may remove some orange peel that was not removed in the sanding step, but may also be used to remove other defects. Finishing means in this context, an optional step or steps, included to further smooth or treat the skin sheet after the sanding operation and prior to the polishing. Included but not limited to the finishing means are intermediate treatments to the skin sheet sanded surface such as with cheesecloth, steel wool, chamois, flap wheel, organic polymers, aluminum oxide powders or granules, and similar materials that will slightly abrade and in a multi-finish step process progressively more lightly abrade the sanded surface of the airplane part such as skin sheet to prepare for a final polishing. In this step it is advisable to use materials that will not contaminate the surface with renegade chemicals agents that might interact with the surface. It is contemplated hereof that like the sanding activity the finishing activity would be fully automated as an optional intermediate step.

The polishing means is well-defined and known to those skilled in this art, however, the importance of polishing to the new process is embraced by the number of passes that a polishing machine makes over the airplane part which as discovered by the present inventor can depend on preparation prior to polishing. The prior art teaches that once a certain maximum number of passes occur the skin sheet may have to be scrapped. Those skilled in this art know that with each pass, certain layers of the aluminum skin sheet, perhaps as a micron or successive micron layers, are removed. As a consequence, multiple metal layers as such maybe removed dependent upon the number of passes that are made over the same sheet.

It has been surprisingly discovered by the inventor hereof that even though the sanding step which on its face appears to be a torturous, abrasive and metal removing step and not here before incorporated in the overall airplane part polishing process, actually removes less of the metal when combined with the polishing step than simply polishing. Accordingly, this leaves a thicker layer of the aluminum or alloy on the surface of the skin sheet.

It is pointed out that the alloys of most significant interest for this new polishing process are the 7000 series alloys, such as 7075 alloys and the 2000 series alloys such as 2219, 2024 and 2524 alloys as registered with the Aluminum Association. In addition, cladding material from the 1000 series alloys also benefit from this new polishing process. These are typically the kind of alloys that are used for the aerospace industry, although there is no reason to suspect that this same polishing technique could not be used for any aluminum and/or aluminum alloy series for other purposes besides aerospace, such as in lighting materials and other transportation mediums such as rail cars, trucks, cars, and boats should a shine be taken to a shine. In addition it is not uncommon, however, for 3000 series such as 3003, 6000 series such as 6013 and 5000 series such as 5051 aluminum alloys to be used in other transportation industry vehicles such as boats and trucks to use polished aluminum alloys, which would benefit from the invention hereof When the specific series of aluminum alloys are mention, mentioning the series includes mentioning each species of the series that may be used for the stated purpose.

DETAILED DESCRIPTION

Figure 1:
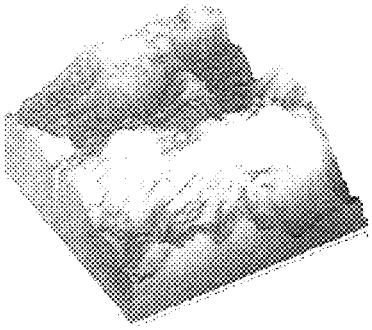
FIG. 1 is a topographical depiction of a prior art surface of an aluminum alloy showing the peaks and valleys after buffing.

The following detailed description is provided to further illustrate the advantages that can be realized by the practice of the present invention and is not intended to limit any of the before mentioned embodiments.

In a present embodiment of this invention a skin sheet was placed on a stable platform and secured thereto. Next, a rotary or orbital mechanical sander was applied to the surface of the skin sheet using 600 grit aluminum oxide sandpaper. The inventor hereof have found that the sanding may be advantageously exercised in a uniform manner such as only sanding lengthwise or widthwise but may also be randomly applied as long as the random application abrades the entire treated surface. It is preferred, however, that the sanding is done in a uniform manner. It is easier under the present understanding of the invention to apply the sander widthwise rather than lengthwise. The sanding is continued until the entire sheet is abraded. Care should be taken to insure that the abraded material is removed in a health conscious and efficient manner such as with a vacuum means to suck up the abraded material as it is abraded.

The abrading material in this sanding step may be ordinary sandpaper, such as 600 grit aluminum oxide which is preferred, but other abrasive means with particles ranging in size from 0.06 to 2.0 millimeters take the form as other oxides and/or carbides can be effective at abrading the surface. When the range of 0.06 to 2.0 mm is presented, included in that range are particle sizes incrementally increasing by 0.01 or 0.1 through the range up to and including about 2.0 mm particle size. The grit size is important but not the critical part of the sanding operation. Grit sizes such as 100 or 200 may be too gritty for a preferred embodiment and grit sizes of 800 may not be grainy enough for this step, although an 800 grit may work very well with a finishing step. When grit ranges are used herein, included in the grit ranges are those grit values that are only incrementally increased or decreased dependent upon the initial range by 10 or 25 grit increments within the range of 100, 200, 300, 400, 500, 600, 700, and 800 inclusive or maybe up to and including about 1000 grit. It is important but not necessary that whatever abrasive means such as sand blasting, rastering, brushing, and/or more rigorous buffing should not leave the surface contaminated with dulling anomalies so as to require an excessive increase in the buffing portion of this process. The contaminants can be removed either by additional buffing or chemical means, for example with appropriate solvents, but this adds an additional step to aggravate an otherwise very efficient operation.

It also is advantageous, but not preferred, that a wet sanding process may be included in the sanding step. When wet sanding, any variety of abrasive carrying liquids, such as water, alcohols such as methyl, ethyl or butyl, and other organic carriers may be used as an admixture with the abrasive and so carry the abrasive on the airplane part surface. An advantage to a wet process is the a decrease in the amount of dust produced. Care must be taken, however, when abrading with organic solvents not to use excessively flammable liquids as it may tend to increase the safety risk.

The time that it takes to complete the sanding step depends on many factors. These factors comprise size of the skin sheet, size of the abrading material, downward pressure exerted by the mechanical sander, the number of workers applying the sanding, or the size of the automated machinery. Typically, for a 100 square foot piece it took approximately 30 minutes to abrade the full sheet. It would not be unusual to sand for from about 10 to maybe 90 minutes, continuously or in 5 minute additional increments within this range. However, those skilled in this art can appreciate that there is no real benchmark for the time to do this particular step since the variables are plenty. The push for the amount of time will derive from the economics. Nonetheless, it is contemplated that this may be completed in a faster or slower time, dependent upon the aforesaid factors. Ultimately, in its most preferred embodiment, at the end of time for sanding, substantially all of the defects, especially the orange peel and blemishes, have been substantially eliminated from the surface of the sheet. This was found to be the case in the present instance.

In an optional step, the now abraded skin sheet may remain in the sanding platform to be finished by either hand or mechanical means to begin the finishing or less severe optional abrading step. This may be done with steel wool or some other less abrasive application than the sanding step such as drawing a rough leather brush across the surface. The time for this step is similar to that expressed in the sanding step although in point of fact may be faster due to a decrease in the frictional factors. The end product in this optional step will be smoother and/or shinier than the surface after sanding.

After either the sanding step or the optional finishing step the polishing step is applied. The sheet was removed from the sanding platform by mechanical lifters and placed on the platform rollers of the polishing machine. After secured in place, the polishing machine was started to begin its pass. Within the polishing area a slight abrasive of aluminum oxide was applied as the polishing roller brush was applied to the abraded surface. In this instance it was discovered that a more than satisfactory polish of the surface was achieved after 4 passes. This was a decrease in the amount of polishing of approximately 400% over the prior art maximum of 40 passes, and about a 200% decrease from the average of 20 prior art passes. It is contemplated with this result that a maximum of 15 passes or less may be needed on any one sheet, although as those skilled in this art know, more polishing could be applied even when not needed.

The Table shows the results of the new inventive process opposite the prior art. Examples 1 and 2 are prior art samples as this practice is executed in today's commercial operations. The remaining data are samples made according to the present invention. The data is in microns as an average of peak to trough or valleys on the surface of the aluminum alloy. Longitudinal and transverse Ra values are a two dimensional average of the data in the X and Y direction of the 3D images found in FIGS. 1, 2, and 3. To determine the peaks and troughs ten point averages-were analyzed and defined as the 5 highest peaks and the 5 lowest valleys. The standard deviation is the average standard deviation of the group.

TABLE

| Examples | Longitudinal roughness Ra | Transverse roughness Ra | Longitudinal mean peak to valley Rz | Transverse mean peak to valley Rz |
|---|---|---|---|---|
| prior art 1 | 0.540 | 0.580 | 1.440 | 1.610 |
| prior art 2 | 1.110 | 0.835 | 2.250 | 2.010 |
| invention ex. 1 | 0.241 | 0.296 | 0.609 | 0.807 |
| mean & std dev | + or − 0.032 | + or − 0.039 | + or − 0.079 | + or − 0.102 |
| invention ex. 2 | 0.267 | 0.321 | 0.801 | 0.724 |
| mean & std dev | + or − 0.059 | + or − 0.075 | + or − 0.121 | + or − 0.157 |
| invention ex. 3 | 0.277 | 0.321 | 0.699 | 0.726 |
| mean & std dev | + or − 0.040 | + or − 0.063 | + or − 0.079 | + or − 0.134 |
| invention ex. 4 | 0.251 | 0.285 | 0.594 | 0.679 |
| mean & std dev | + or − 0.32 | + or − 0.055 | + or − 0.068 | + or − 0.110 |
| average for invention ex | 0.259 | 0.306 | 0.677 | .734 |

The percent specular improvement over the prior art is surprisingly large. For the longitudinal roughness there is a 28% improvement over the best prior art value in the Table. For the transverse roughness there is a 27% improvement over the best prior art value in the Table. For the longitudinal peak to valley there is a 76% improvement over the best prior art value in the Table. Finally, for the transverse peak to valley there is a 88% improvement over the best prior art value in the Table. This all when compared to the average values for all of the samples of the invention and are compared as minimal prior art values. Accordingly, the invention hereof provides a range of Ra values for longitudinal and transverse roughness and a range of Rz values for peak to valleys. The Ra range is from about 0.200 to about 0.400 for longitudinal roughness, 0.200 to about 0.400 for transverse roughness. Preferably an Ra of about 0.220 to about 0.380, most preferably an Ra of about 0.240 to about 0.350 for both longitudinal and transverse roughness. For peak to valley Rz values, the range may be about 0.300 to about 1.100, preferably an Rz value range of about 0.400 to about 1.000, most preferably an Rz range of about 0.500 to about 0.900. It is understood that the incremental increases within these ranges may be at 0.001 Ra and Rz values up to and including the maximum range limit for each range. The use of the Ra and Rz quantities, are useful in quantifying what is meant by shiny and smooth. However, to those skilled in the art, as is the inventor hereof, the surprise came from a visual inspection, wherein the eye beheld a smoother and shiner reflection that was immediately noticeable over the prior art.

Figure 2:
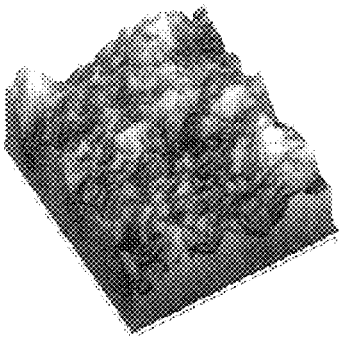
FIG. 2 is an additional topographical depiction of a prior art surface of an aluminum alloy showing the peaks and valleys after buffing which is not as smooth as that in FIG. 1.
Figure 3:
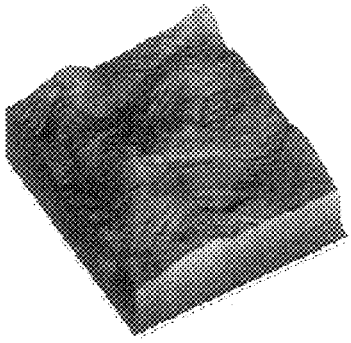
FIG. 3 is a topographical depiction of the surface of the present invention.

In a more illustrative presentation of the above, FIG. 1 and FIG. 2 depict the prior art examples 1 and 2, respectively. FIG. 3 is the depiction of the inventive surface from a topographical perspective. It is clear the inventive process has produced a surface with lower peaks and higher valleys so that the peaks and valleys seem to converge to a plain.

What is claimed is:

1. A process for making an aluminum or aluminum alloy surface smooth and shiny for use as an airplane part wherein substantially the entire outside surface of said airplane part or portions thereof are sanded and subsequently substantially the entire sanded surface of said airplane part or portions thereof are buffed.

2. The process of claim 1 wherein said sanding comprises the use of a single or a plurality of communicating mechanical sanders to remove blemishes, to smooth, and to shine said airplane part.

3. The process of claim 1 wherein said sanding step is followed by a single or plurality of optional intermediate finishing steps.

4. The process of claim 2 wherein said sanders comprise circular or rotary heads communicating with an abrasive means for sanding the surface of said airplane part.

5. The process of claim 1 wherein said sanding removes a portion of the defects and blemishes.

6. The process of claim 1 wherein said sanding removes a majority but less than substantially all of the defects and blemishes.

7. The process of claim 1 wherein said sanding removes substantially all of the defects and blemishes.

8. The process of claim 1 wherein said sanding removes defects and blemishes selected from the group consisting of orange peels, dirt, metal filings, slivers, and combinations thereof.

9. The process of claim 4 wherein said abrasive means is selected from the group of 100, 200, 300, 400, 500, 600, 700, 800 grit sandpaper and a combination thereof.

10. The process of claim 1 wherein said airplane part is selected from a wing structure, a fuselage, empennage, or combinations thereof.

11. The process of claim 4 wherein said abrasive means is selected from particles ranging in size from 0.06 millimeters to 2.0 millimeters.

12. The process of claim 1 wherein said aluminum alloy is selected from 1000, 2000, 3000, 5000, 6000, and 7000 series aluminum alloys.

13. The process of claim 1 wherein said aluminum alloy is selected from 2219, 2024 or 2524 series aluminum alloy.

14. The process of claim 1 wherein said aluminum alloy is selected from 7075 series aluminum alloy.

15. The process of claim 1 wherein said sanding comprises liquid sanding wherein said liquid is selected from the group consisting of water, alcohol, organic liquids and a combination thereof.

16. The process of claim 1 wherein said sanding is from about 15 to 45 minutes in duration.

17. The process of claim 1 wherein said airplane part is buffed for about 15 passes or less.

18. The process of claim 1 wherein said airplane part is buffed for about 4 passes or less.

19. A process for making an aluminum or aluminum alloy surface smooth and shiny for use as an airplane part wherein substantially the entire outside surface of said airplane part or portions thereof are sanded and subsequently substantially the entire sanded surface of said airplane part or portions thereof are buffed whereby an Ra value for longitudinal and transverse roughness is about 0.200 to about 0.400 and the range of values for Rz peak to valley is about 0.300 to about 1.100.

20. A process for making an aluminum or aluminum alloy surface smooth and shiny for use as an airplane part wherein substantially the entire outside surface of said airplane part or portions thereof are sanded and subsequently substantially the entire sanded surface of said airplane part or portions thereof are buffed whereby an Ra value for longitudinal and transverse roughness is about 0.220 to about 0.380 and the range of values for Rz peak to valley is about 0.400 to about 1.00.

21. A process for making an aluminum or aluminum alloy surface smooth and shiny for use as an airplane part wherein substantially the entire outside surface of said airplane part or portions thereof are sanded and subsequently substantially the entire sanded surface of said airplane part or portions thereof are buffed whereby an Ra value for longitudinal and transverse roughness is about 0.240 to about 0.350 and the range of values for Rz peak to valley is about 0.500 to about 0.900.

22. The process of claim 19 wherein said sanding comprises the use of a single or a plurality of communicating mechanical sanders to remove blemishes, to smooth, and to shine said airplane part.

23. The process of claim 19 wherein said sanding step is followed by a single or plurality of optional intermediate finishing steps.

24. The process of claim 19 wherein said sanders comprise circular or rotary heads communicating with an abrasive means for sanding the surface of said airplane part.

25. The process of claim 19 wherein said sanding removes a portion of the defects and blemishes.

26. The process of claim 19 wherein said sanding removes a majority but less than substantially all of the defects and blemishes.

27. The process of claim 19 wherein said sanding removes substantially all of the defects and blemishes.

28. The process of claim 19 wherein said sanding removes defects and blemishes selected from the group consisting of orange peels, dirt, metal filings, slivers, and combinations thereof.

29. The process of claim 24 wherein said abrasive means is selected from the group of 100, 200, 300, 400, 500, 600, 700, 800 grit sandpaper and a combination thereof.

30. The process of claim 19 wherein said airplane part is selected from a wing structure, a fuselage, empennage, and combinations thereof.

31. The process of claim 24 wherein said abrasive means is selected from particles ranging in size from about 0.06 to about 2.00 millimeters.

32. The process of claim 19 wherein said aluminum alloy is selected from the 1000, 2000, 3000, 5000, 6000, and 7000 series aluminum alloys.

33. The process of claim 19 wherein said aluminum alloy is selected from 2219, 2024 or 2524 series aluminum alloy.

34. The process of claim 19 wherein said aluminum alloy is selected from 7075 series aluminum alloy.

35. The process of claim 19 wherein said sanding comprises liquid sanding wherein said liquid is selected from the group consisting of water, alcohol, organic liquids and a combination thereof.

36. The process of claim 19 wherein said sanding is from about 15 to 45 minutes in duration.

37. The process of claim 19 wherein said airplane part is buffed for about 15 passes or less.

38. The process of claim 19 wherein said airplane part is buffed for about 4 passes or less.

39. An airplane part comprised of 7000 series aluminum alloy wherein the longitudinal Ra value ranges from about 0.200 to about 0.400.

40. The airplane part of claim 39 wherein said longitudinal Ra value ranges from about 0.220 to about 0.380.

41. The airplane part of claim 39 wherein said longitudinal Ra value ranges from about 0.240 to about 0.350.

42. The airplane part of claim 39 selected from the group consisting of a wing structure, fuselage, empennage, and a combination thereof.

43. An airplane part comprised of 7000 series aluminum alloy wherein the transverse Ra value ranges from about 0.200 to about 0.400.

44. The airplane part of claim 43 comprised of 7000 series aluminum alloy wherein the transverse Ra value ranges from about 0.220 to about 0.380.

45. The airplane part of claim 43 comprised of 7000 series aluminum alloy wherein the transverse Ra value ranges from about 0.240 to about 0.350.

46. The airplane part of claim 43 selected from the group consisting of a wing structure, fuselage, empennage, and a combination thereof.

47. An airplane part comprised of 2000 series aluminum alloy wherein the longitudinal Ra value ranges from about 0.200 to about 0.400.

48. The airplane part of claim 47 comprised of 2000 series aluminum alloy wherein the longitudinal Ra value ranges from about 0.220 to about 0.380.

49. The airplane part of claim 47 comprised of 2000 series aluminum alloy wherein the longitudinal Ra value ranges from about 0.240 to about 0.350.

50. The airplane part of claim 47 wherein said part is selected from a wing structure, a fuselage, an empennage, or some combination thereof.

51. An airplane part comprised of 2000 series aluminum alloy wherein the transverse Ra value ranges from about 0.200 to about 0.400.

52. The airplane part of claim 51 comprised of 2000 series aluminum alloy wherein the transverse Ra value ranges from about 0.220 to about 0.380.

53. The airplane part of claim 51 comprised of 2000 series aluminum alloy wherein the transverse Ra value ranges from about 0.240 to about 0.350.

54. The airplane part of claim 51 wherein said part is selected from a wing structure, a fuselage, an empennage or some combination thereof.

55. An airplane part comprised of 7000 series aluminum alloy wherein the longitudinal Ra value ranges from about 0.200 to about 0.400 and the transverse Ra ranges from about 0.200 to about 0.400.

56. The airplane part of claim 55 comprised of 7000 series aluminum alloy wherein the longitudinal Ra value ranges from about 0.220 to about 0.380 and the transverse Ra ranges from about 0.220 to about 0.380.

57. The airplane part of claim 55 comprised of 7000 series aluminum alloy wherein the longitudinal Ra value ranges from about 0.240 to about 0.350.

58. The airplane part of claim 55 wherein said part is selected from the group consisting of a wing structure, fuselage, empennage or some combination thereof.

59. An airplane part comprised of 2000 series aluminum alloy wherein the longitudinal Ra value ranges from about 0.200 to about 0.400 and the transverse Ra ranges from about 0.200 to about 0.400.

60. The airplane part of claim 59 comprised of 2000 series aluminum alloy wherein the longitudinal Ra value ranges from about 0.220 to about 0.380 and the transverse Ra ranges from about 0.220 to about 0.380.

61. The airplane part of claim 59 comprised of 2000 series aluminum alloy wherein the longitudinal Ra value ranges from about 0.240 to about 0.350.

62. The airplane part of claim 59 wherein said part is selected from the group consisting of a wing structure, fuselage, empennage or some combination thereof.

* * * * *